United States Patent [19]

Shlykov et al.

[11] 4,280,252

[45] Jul. 28, 1981

[54] DOUBLE-APRON DRAWING MECHANISM

[76] Inventors: Gennady N. Shlykov, Chilanzar, kvartal 19, 31, kv. 3; Vasily M. Dyachkov, Kuiljuk-4, 23-a, kv. 11; Vitaly I. Zhestkov, Chilanzar, kvartal 19, 26, kv. 41; Valentin N. Tikhonov, ulitsa Sh.Rustaveli, 55, kv. 28, all of Tashkent, U.S.S.R.

[21] Appl. No.: 60,019

[22] Filed: Jul. 23, 1979

[51] Int. Cl.[3] ..... D01H 5/88

[52] U.S. Cl. ..... 19/255; 19/256

[58] Field of Search ..... 19/244, 249, 250, 251, 19/256, 255

[56] References Cited

U.S. PATENT DOCUMENTS

| | | | |
|---|---|---|---|
| 2,179,078 | 11/1939 | Allwood | 19/256 |
| 2,695,428 | 11/1954 | Naegeli | 19/256 X |

FOREIGN PATENT DOCUMENTS

| | | | |
|---|---|---|---|
| 2094211 | 2/1972 | France | 19/256 |
| 364698 | 2/1973 | U.S.S.R. | 19/256 |

*Primary Examiner*—Louis Rimrodt

*Attorney, Agent, or Firm*—Robert E. Burns; Emmanuel J. Lobato; Bruce L. Adams

[57] ABSTRACT

The double-apron drawing mechanism includes a feed couple of rollers and a delivery couple of rollers, with the fibrous material being treated passing between the two endless aprons or belts of the feed couple, synchronously rotated about the driven and pressure rollers. One endless apron engages a stationary guide extending longitudinally of the travel of the fibrous material, while the other endless apron engages a movable guide arranged adjacent to the area of exit of the fibrous material from the feed couple toward the delivery couple.

The movable guide is mounted for infinite angular adjustment in vertical planes extending both transversely and longitudinally of the travel of the fibrous material, to provide for infinite adjustment of the gap between the endless aprons in the area of exit of the treated fibrous material from the feed couple.

5 Claims, 5 Drawing Figures

DOUBLE-APRON DRAWING MECHANISM

FIELD OF INVENTION

The invention relates to textile machinery engineering, and more particularly it relates to double-apron drawing devices of textile machines.

The invention can be used to utmost effectiveness in ringless spinning machines.

BACKGROUND OF INVENTION

One of the major functions of double-apron drawing mechanisms of textile machines is creating a space for a fibrous material being treated, wherein there are produced friction forces both between the fibres of the fibrous material itself and between the fibres of the material and the elements of the drawing mechanism. These friction forces should be sufficient to shape the relatively dense mass of the treated fibrous material. The space wherein the friction forces are produced in the abovedescribed manner is sometimes called the friction force field having a certain intensity value. The intensity value of such a friction force field is the mean friction force applied in the respective area of the friction force field to one millimeter of the treated fibre in the direction of the travel of the fibrous material. This intensity value varies in dependence on the value of the load acting perpendicularly to the travel of the treated fibrous material, and also on the thickness and the structure of this fibrous material.

There is known a drawing mechanism (cf. the SU Inventor's Certificate No. 364,696) wherein the treated fibrous material is made to pass between two endless aprons or belts of the feed couple, synchronously rotated about rolls or rollers, wherefrom it is directed into the delivery couple.

One endless apron is associated with a stationary guide extending longitudinally of the travel of the fibre, while the other endless apron is associated with a movable guide arranged adjacent to the area of exit of the fibrous material from the feed couple toward the delivery couple. The movable guide provides for stepwise or incremental adjustment of the gap between the endless aprons in the area of exit of the treated fibrous material from the feed couple in a vertical plane extending transversely of the travel of the treated fibrous material.

It is understandable that the adjustment of the gap between the aprons is essential for creating the optimum distribution of the friction force files in cases of fibrous materials differing by their composition, structure and thickness, to enhance the process of drawing the fibrous material, as the latter is being transferred from the feed couple into the delivery one.

This, in its turn, is essential for improving the yarn quality. And from this point of view it should be stated that the aforementioned drawing mechanism of the prior art is not free from drawbacks.

Firstly, in this mechanism the movable guide provides for but stepwise or incremental adjustment of the gap between the endless aprons in the area of exit of the fibrous material being treated from the feed couple. This limitation would not enable to ensure the optimum distribution of the friction force fields for the entire broad range of the thicknesses of the treated fibrous material and of its possible compositions, and hence would eventually affect the drawing process and cause unevenness of the yarn.

Secondly, the adjustment of the gap between the endless aprons in the area of exit of the treated fibrous material from the feed couple into the delivery one is effected in the drawing mechanism of the prior art solely by the angular adjustment of the movable guide in a vertical plane extending longitudinally of the travel of the fibrous material being treated.

Thus, in case the fibrous material treated in the double-apron drawing mechanism is droplet-shaped in cross-section, i.e. one end portion of this treated fibrous material in cross-section is substantially thicker than the other one, the thinner end or side might all but fail to engage one of the endless aprons. Consequently, there cannot be ensured the optimum distribution of the friction force fields in the body of the material being treated throughout the width thereof. This eventually results in that the material being drawn from the feed couple is made up of not individual or discrete fibres, but of groups of fibres, which also affects the quality of the year to be produced.

SUMMARY OF THE INVENTION

It is an object of the present invention to arrange the movable guide of a double-apron drawing mechanism so that it should provide for having the optimum distribution of the friction force fields within the fibrous material being treated by adjusting the gap between the endless aprons over the entire surface of the treated fibrous material in the area of its exit from the feed couple toward the delivery one.

This and other objects are attained in a double-apron drawing mechanism wherein the fibrous material being treated is made to pass between two endless aprons of the feed couple, rotated in synchronism about rollers, one of the aprons engaging a stationary guide extending longitudinally of the travel of the treated fibrous material, and the other endless apron engaging a movable guide arranged adjacent to the area of exit of the fibrous material from the feed couple toward the delivery couple, in which mechanism, in accordance with the present invention, the movable guide is mounted for infinite angular adjustment in vertical planes extending both transversely and longitudinally of the travel of the treated fibrous material, to provide for infinite adjustment of the gap between the endless aprons in the area of exit of the treated fibrous material from the feed couple.

The drawing mechanism of the herein disclosed structure enables:

(1) to infinitely adjust the gap between the endless aprons in the area of exit from the feed couple, depending on the thickness of the treated fibrous material, it composition and structure, as well as on the required distribution of the friction force fields in the gap between the endless aprons. This is attained owing to the provisions for infinite angular adjustment of the movable guide in a vertical plane extending longitudinally of the travel of the fibrous material being treated. This manner of adjustment of the said gap enables to distribute the friction force field optimally throughout the width of the fibrous material, which eventually yields improved quality of the yard;

(2) to infinitely adjust the gap between the endless aprons at the exit from the feed couple in operation of the drawing mechanism. This is attained by infinitely angularly adjusting the movable guide in operation of the drawing mechanism in a vertical plane extending transversely of the travel of the fibrous material being treated. Thus, even with the cross-sectional shape of the treated fibrous material varying, as the material passes between the endless aprons of the drawing mechanism in its operation, such angular adjustment of the movable guide enables to have the entire surface of the material, adjoining the surface of the endless aprons, snugly engaging this surface of the aprons. This enables to have the optimum distribution of the friction force field in the aforementioned gap throughout the width of the material being treated, which eventually also improves the quality of the yearn to be produced.

It is expedient that the movable guide be connected with the shaft of the pressure roller through an L-shaped link of which one portion is freely rotatable about the shaft of the pressure roller, while the guide carrier portion of the L-shaped link comprises a part connected via an axle to a holder, for relative rotation of this part and of the holder in a vertical plane extending longitudinally of the travel of the treated fibrous material, the holder being connected with the movable guide for angular adjustment of this movable guide relative to the holder in a vertical plane extending transversely of the travel of the treated fibrous material.

One should not overlook the simplicity of the L-shaped link affording the connection between the movable guide and the shaft of the pressure roller; besides, the structure of the L-shaped link simplifies the task of providing for the abovedescribed angular adjustments of the movable guide.

It is further expedient that one end of the axle should be rigidly connected to the holder, the other end of the axle being freely or rotatably received in an opening provided in the part, the latter having a retaining or lock screw for retaining this axle.

This structure of the supporting guide affords unobstructed access to the part with the retaining screw for setting the gap between the endless aprons, even when the feed couple is of a relatively small size, i.e. when the spacing of the pressure roller from the movable guide is so small that it impedes the access to the zone under the endless apron.

Alternatively, it may be expedient that one end of the axle should be rigidly attached to the part connected to the holder, the other end of the axle being freely or rotatably received in an opening provided in the holder, the latter having a retaining or lock screw for retaining the axle. This structure of the guide carrier is preferable when the spacing of the pressure roller from the movable guide is sufficiently large, because it enables to reduce the width of the feed couple.

It may be also expedient that the movable guide should have an axle having its one end rigidly attached to this movable guide, the other end being freely or rotatably received in an opening provided in the holder of the L-shaped link.

The simplicity of the connection of the movable guide with the holder of the L-shaped link is worth mentioning, providing as it does in a simple manner for angular adjustment of the movable guide in operation of the drawing mechanism.

According to an alternative embodiment of the present invention, the movable guide is in the form of a U-shaped part, the holder being provided with a rectangular plate with two projections of a triangular shape in cross-section, arranged at the opposite sides of the plate in opposition to each other, the plate being accommodated intermediate the legs of the U-shaped part so that the projections are adapted to engage the inner surface of the U-shaped part centrally thereof.

This structure of the movable guide and its connection with its holder are essentially simple.

BRIEF DESCRIPTION OF THE DRAWINGS

The invention will be further described in connection with embodiments thereof, with reference being had to the accompanying drawings, wherein.

DESCRIPTION OF THE PREFERRED EMBODIMENTS

Figure 1:
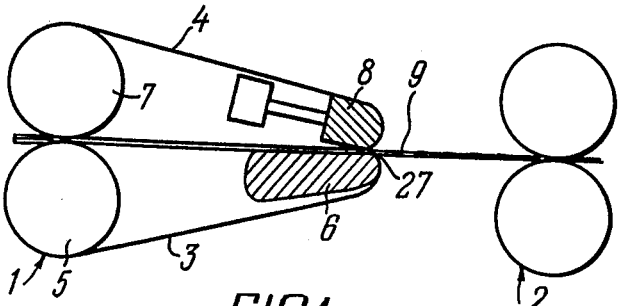
FIG. 1 illustrates schematically a double-apron drawing mechanism.

Referring now in particular to the appended drawings, a double-apron drawing mechanism illustrated in FIG. 1 comprises a feed couple 1 and a delivery couple 2.

The feed couple 1 includes a pair of endless aprons or belts 3 and 4 rotatable in synchronism.

The endless apron 3 has its inner surface running about a driven roller 5 and about a stationary guide 6, the driven roller 5 is connected to a drive (not shown) for rotating the driven roller 5.

The endless apron 4 has its inner surface running about a pressure roller 7 and a movable guide 8.

The endless drives 3 and 4 cooperate over an area of contact wherein a fibrous material 9 being treated.

The stationary guide 6 extends longitudinally of the travel of the fibrous material 9 being treated. The movable guide 8 is arranged in the area of exit of the treated fibrous material 9 from the feed couple 1.

Figure 2:
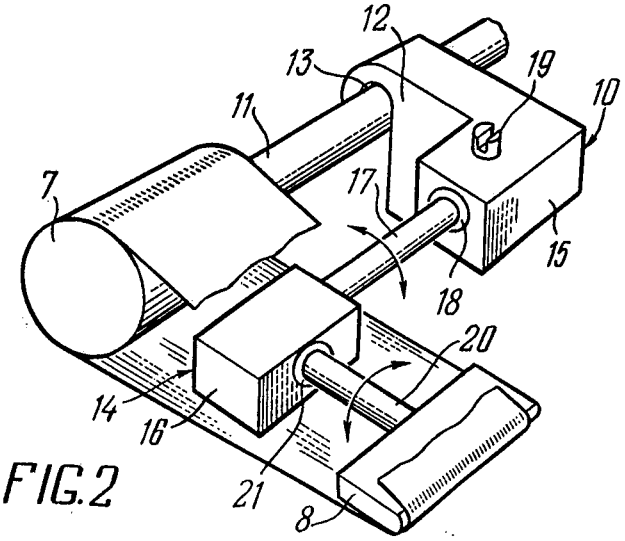
FIG. 2 is a schematic perspective view of the feed couple of a double-apron drawing mechanism in accordance with the invention, with one of the embodiments of an L-shaped link and the movable guide.

The movable guide 8 (FIG. 2) is connected via an L-shaped link 10 to the shaft 11 supporting the pressure roller 7.

One portion 12 of the link 10 is in the form of a plate with a recess 13 by means of which the L-shaped link 10 is freely received about the shaft 11 of the pressure roller 7.

The other or carrier portion 14 of the link 10 includes a part 15 and a holder 16 interconnected by an axle 17. According to one embodiment of the L-shaped link 10, one end of the axle 17 is made fast with the holder 16, e.g. by welding, while the other end of the axle 17 is loosely or rotatably received in an opening 18 provided in the part block 15. The latter has a retaining or lock screw 19 for retaining the axle 17 in an adjusted position in the opening 18 in the part 15.

The portion 12 of the link 10 is made fast with the part 15, e.g. by welding.

The movable guide 8 is provided with an axle 20 of which one end is made fast with this movable guide 8, e.g. by welding, while its other end is loosely or rotatably received in an opening 21 provided in the holder 16.

Figure 3:
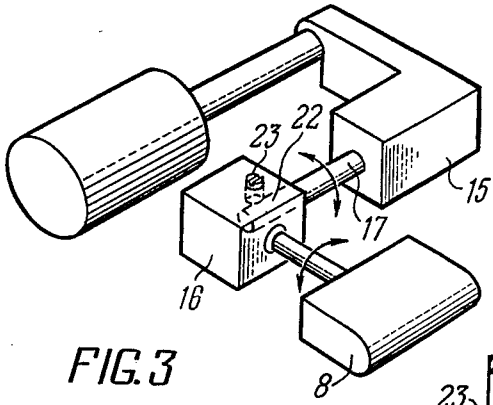
FIG. 3 is a schematic perspective view of a feed couple of a double-apron drawing mechanism in accordance with the invention, with a different embodiment of the L-shaped link.

According to another embodiment of the present invention, the axle 17 (FIG. 3) has its one end made fast with the part 15, e.g. by welding, while its other end is rotatably received in an opening 22 provided in the holder 16, the latter is also provided with a retaining screw 23 for retaining the axle 17 in an adjusted position in the opening 22 of the holder 16.

Figure 4:
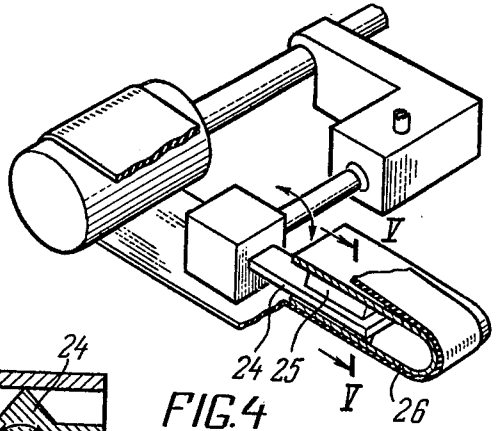
FIG. 4 is a schematic perspective view of the feed couple of a double-apron drawing mechanism in accordance with the present invention, with a different embodiment of a movable guide.
Figure 5:
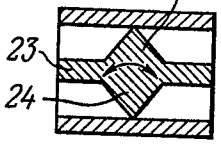
FIG. 5 is a sectional view taken on section line V—V of FIG. 4.

According to a still another embodiment of the present invention, the holder 16 (FIG. 4) has rigidly attached thereto, e.g. by welding, a rectangular plate 25. The plate 24 has two projections 25 on its opposite sides, arranged in opposition to each other, the projections 25 (FIG. 5) is triangular in cross-section. The projections 25 (FIG. 5) extend in the direction of the travel of the fibrous material 9 being treated.

In this embodiment the movable guide 26 is in the form of a U-shaped part, the plate 24 with the projections 25 being accommodated intermediate the legs of this U-shaped guide 26, with the projections 25 engaging the inner surface of the V-shaped guide 26 centrally thereof.

The herein disclosed double-apron drawing mechanism operates, as follows.

Prior to starting the operation of the drawing mechanism (FIGS. 1 and 2), there is set the gap 27 between the endless aprons 3 and 4 in the area of exit of the fibrous material 9 being treated from the feed couple 1. This gap 27 is set to correspond to the thickness of the treated fibrous material 9, its composition and structure, and also in accordance with the required distribution of the friction force fields within the material 9.

This setting or adjustment of the gap 27 between the endless aprons 3 and 4 is effected by turning the axle 17 in the opening 18 of the part 15, whereafter, with the required gap 27 having been set, the adjusted position of the axle 17 is fixed with the retaining screw 19.

In accordance with the other embodiment of the present invention, the gap 27 (FIG. 3) is preset by turning the axle 17 in the opening 33 of the holder 16 and fixing it in the adjusted position with the retaining screw 23. The drive (not shown) is energized to rotate the driven roller 5, whereby the endless apron 3 running about this driven roller 5 and the stationary guide 6 is set in motion.

The fibrous material 9 being treated is supplied into the feed couple 1, i.e. into the gap between the endless aprons 3 and 4., whereby the endless apron 4 starts rotating in synchronism with the endless apron 3 by running about the pressure roller 7 and the movable guide 8.

The passage rate of the fibrous material 9 being treated is set by the speed of the motion of the endless aprons 3 and 4.

From the feed couple 1 the treated fibrous material 9 exits toward the delivery couple 2, whereby it is accelerated still further.

More often than not the fibrous material 9 being treated has a significant degree of unevenness, i.e. different widths at its sides or ends in the cross-section. If this is the case, the said unevenness of the fibrous material 9 in the lateral direction makes the movable guide turn on the axle 19 received in the opening 20 of the holder 16, so that the endless apron 4 has its entire external surface engaging the surface of the fibrous material 9 being treated.

The utilization of the herein disclosed double-apron drawing mechanism enables to enhance significantly the quality of the yarn being produced, notwithstanding the unevenness of the fibrous material being treated.

It should be understood that the abovedescribed embodiments of the present invention, illustrated in the appended drawings, serve the purposes of illustration only, and that various changes and modifications may take place without departing from the spirit and scope of the invention, as defined in the appended claims.

What we claim is:

1. A double-apron drawing mechanism comprising, a feed couple for feeding a fibrous material along a longitudinal path of travel; a delivery couple for said fibrous material on said path of travel downstream of said feed couple; two driven endless aprons on said feed couple driven in synchronism and having two opposed runs defining a treatment zone in said path of travel for said fibrous material passed between said opposed runs; said feed couple comprising a pair of driven rolls one of which is a pressure roll; said delivery couple being disposed downstream from an exit end of said treatment zone at which said fibrous material exits; a fixed stationary feed guide of said feed couple spaced from one of said rolls for guiding and supporting one of said endless aprons traveling over said stationary guide, said stationary guide maintaining said one apron extended longitudinally, said stationary guide being disposed opposite a movable guide on said feed couple for guiding and supporting the other of said aprons traveling over the movable guide and maintaining said other apron extended longitudinally, said stationary guide being disposed adjacent said exit end; mounting means mounting said movable guide in the vicinity of said exit end of said treatment zone for variably adjusting a gap between said runs of the aprons, comprising a driving shaft for said pressure roll, a link mounted on said shaft comprising a guide carrier pivotally mounted for carrying said movable guide and movable variably angularly to position said movable guide in inclination relative to a plane extending parallel to said path of travel, and a pivotally mounted holder for said movable guide movable variably angularly to position the movable guide in inclination transversely of said plane.

2. A double-apron drawing mechanism according to claim 1, in which said carrier mounts said holder pivotally, and means pivotally connecting said holder to said carrier.

3. A double-apron drawing mechanism according to claim 1, in which said link comprises a block mounted on said shaft, an axle on said block pivotal about its longitudinal axis mounting said carrier, said axle extending in a direction transversely of said plane.

4. A double-apron drawing mechanism according to claim 3, including another axle pivotal about its longitudinal axis mounting said holder pivotal relative to said carrier, said another axle extending in the direction of said path of travel of said fibrous material.

5. A double-apron drawing mechanism according to claim 1, in which said movable guide has a U-shaped cross section; said holder comprising a plate having a V-shaped cross section, and said holder being disposed intermediate the legs of the U-shaped movable guide.

* * * * *